US005484007A

United States Patent [19]

Rejc

[11] Patent Number: 5,484,007

[45] Date of Patent: Jan. 16, 1996

[54] VERTICAL LIFT GATE WITH STRIP CLADDING IN GUIDEWAYS

[76] Inventor: Gabrijel Rejc, Falkenstr. 46, Landshut, Germany, D-8300

[21] Appl. No.: 259,050

[22] Filed: Nov. 10, 1992

Related U.S. Application Data

[63] Continuation of a PCT/EP9a/00885 filed, May 13, 1991.

[30] Foreign Application Priority Data

May 11, 1990 [DE] Germany ..... 40 15 215.4
May 13, 1991 [WO] WIPO ..... PCT/EP91/00885

[51] Int. Cl.[6] ..... E06B 9/08

[52] U.S. Cl. ..... 160/133; 160/189

[58] Field of Search ..... 160/133, 310, 160/265, 201, 40, 189

[56] References Cited

U.S. PATENT DOCUMENTS

| | | | |
|---|---|---|---|
| 1,665,028 | 4/1928 | Halvorsen | 160/133 |
| 2,726,911 | 12/1955 | Mason | 160/133 X |
| 3,118,702 | 1/1964 | Kale et al. | 160/210 X |
| 3,357,480 | 12/1967 | Matsumoto | 160/133 |
| 3,516,469 | 6/1970 | McDonald | 160/133 X |
| 4,120,340 | 10/1978 | Stascavage et al. | 160/133 |
| 4,947,937 | 8/1990 | Searer et al. | 160/133 |
| 4,997,022 | 3/1991 | Klein | 160/265 |
| 5,129,442 | 7/1992 | Warner | 160/265 X |
| 5,141,044 | 8/1992 | Hying et al. | 160/265 X |

*Primary Examiner*—David M. Purol
*Attorney, Agent, or Firm*—Nixon & Vanderhye

[57] ABSTRACT

A lifting door includes a plurality of slats pivotally connected one to the other for pivotal movement about horizontal axes. Each slat carries at opposite ends a guide. Guide tracks are disposed in a door aperture for guiding the door during opening and closing. The guide tracks above the door aperture extend in a generally inwardly directed spiral configuration whereby, upon opening the door, the slats are guided about the spirally configured guide tracks into an open position without engaging one another.

9 Claims, 7 Drawing Sheets

VERTICAL LIFT GATE WITH STRIP CLADDING IN GUIDEWAYS

RELATED APPLICATIONS

This invention is a continuation of PCT Application No. PCT/EP91/00885, filed May 13, 1991.

BACKGROUND OF THE INVENTION

The invention relates to a lifting door with a slatted armor which is movable vertically upwards from a closed position into an open position relative to a door aperture.

A known example of a lifting door is a rolling door which functions as a vertically opening closure of a walk-through or drive-through door aperture. Such lifting door conventionally consists essentially of a rolling armor, having mutually pivotally connected slats which are guided into the closed position at the two side edges of the door aperture by means of vertical guide rails, a winding shaft to which the rolling armor is fastened for moving in response to an electromotive drive, and a catch device which prevents the rolling armor from crashing down in the event of a failure of the drive.

The rolling armor functioning as the part of a rolling closure which closes off and protects the door aperture consists of slats, generally profiled parts, for example extruded aluminum materials, connected to one another in an articulated manner. The height of the individual slats is, generally approximately 80 to 120 mm. These profiled parts are usually provided as push-in profiles which, on account of their shape, are connected to one another in an articulated manner, without further connecting members, to form the rolling armor. In a typical aluminum extruded profile, the joint is designed, for example, as a cup and web, so that, with the profiles pushed into one another, the joint thus formed can absorb and withstand the forces occurring when the rolling armor is being wound up. The connection of the slats which is shaped to form a joint has, generally, a large play.

Moreover, with the profiles pushed into one another, dirt and water are prevented from settling in the joints and sufficient sealing against wind is provided.

The roll layers on the winding shaft are formed by the interconnected profiles which have a specific profile height. Each profile is laid onto the edge of a profile which projects most of the layer located underneath it. The direction which a profile assumes within its roll layer in the cross-section of the roll depends on the bearing point of the profile. By its randomly assumed position, it also determines, in turn, the arrangement of the next profile connected to it. This results, with the roll wound up, in an irregular layered arrangement of the individual profiles of the rolling door. It follows from this, that, for example, only a single edge of a single profile of the rolling door supports the entire load of the armor part still hanging freely, as a consequence of which considerable edge pressures can occur.

As a safeguard against lateral displacement, head pieces or end pieces, which run in corresponding vertical guide rails each having a generally U-shaped cross-section, are, typically, fastened laterally to the profiles of the rolling door. These vertical guides are widened in a funnel-shaped manner at their upper entrance, so that the rolling armor, when being unrolled, can run perfectly into the vertical guide without the risk that it will become caught.

The rolling armor is fastened by means of its initial profile to the winding shaft in such a way that, with the door closed, the fastening is located on the side of the shaft facing away from the armor. Thus, the armor or the end plates lengthens the armor loop round the shaft by at least 180°. This ensures that the armor is held largely by frictional forces, and therefore the full dead weight of the armor does not act upon the suspensions. The door is closed when the tail profile rests sealingly on the lower edge of the aperture, i.e., generally on the ground. Moreover, the rolling armor should not collapse. The entire armor, with the exception of the tail profile, thus remains hanging as a load on the shaft or shaft axle. The rolling door thereby differs fundamentally from the roller blind which is usually provided as an additional closure of an aperture.

In the open position of the rolling door, the rolling armor rolled up onto the winding shaft is located in the lintel region of the door aperture. The drive usually lies protected behind the lintel and therefore cannot be damaged by vehicles when they drive through the door aperture. An electric motor is typically provided as a drive, and furthermore a hand-operated drive is available for temporary operation.

An electric drive is employed and the rolling-door shaft is driven at a constant rotational speed, i.e., at a uniform angular speed. The rolling armor fastened to the shaft is thereby raised and wound up onto the shaft. A critical factor in the lifting speed is the particular effective winding radius which is increased continuously during the winding, since the lower parts of the rolling armor are laid onto the already wound upper parts. Since the lifting speed changes in direct proportion to the roll radius, a rolling door first runs upwards slowly, becoming more and more rapid in the upward direction. In a closer consideration of the kinematic conditions, and allowing for the thickness and height of the profiles, the rolling-door roll must be viewed as a polygon. During the winding, the profiles are first laid onto the round winding shaft. The straight profiles form a polygon thereon. At the same time, the corners of the polygon are further from the center point of the shaft than the centers of a side of the polygon. When the shaft of the rolling door is rotated at a constant angular speed, the rolling armor is pulled up with a lever arm corresponding to the length to the corner point of the polygon and at the lifting speed corresponding to this lever-arm length and in the next moment with a lever arm corresponding to the length to a side of the polygon and at the lifting speed corresponding to this. The lifting speed is directly proportional to the particular effective lever arm occurring discontinuously and irregularly and is therefore characterized, during the winding of the rolling armor, by correspondingly pronounced and sudden fluctuations. This is accompanied by mass accelerations and decelerations of fluctuating amounts of the still unwound mass of the rolling armor. These mass accelerations also enter the gear of the drive motor, which gear has to be designed for an appropriate degree of non-uniformity, since breakdowns can otherwise occur. These accelerations are smaller, the thicker the rolling-door roll becomes, i.e., the more the polygon approximates a circle. However, since the highest mass accelerations and decelerations occur when the rolling armor is closer to its closed position, these forces are therefore still mutually augmented as a result of the appreciable dead weight of the rolling armor.

The accelerations and decelerations of the masses of the unwound rolling armor have the effect of vibrations. These vibrations also act by way of the winding shaft on the building, and therefore it must be ensured in the static calculation of the building that the natural vibration frequency remains outside the rolling-door frequencies. Otherwise, the lifting speed of the rolling door has to be drastically reduced. At a uniform angular speed of the rolling-door shaft, with a thickening rolling-door roll the frequency of the vibrations will increase and their amplitude decrease. This means, conversely, that the generation of sound during the actuation of the rolling door becomes greater, the further the rolling armor comes down.

In addition to the abovementioned irregularities in the lever-arm ratios during the winding of the profiles in the form of polygonal courses, in the case of the hitherto known rolling doors there is a further irregularity which also leads to extremely problematic kinematic conditions. Since the driven shaft of a rolling door cannot exert any pressure forces on the rolling armor, it is necessary to ensure that, in the raised state, the falling weight of the freely hanging part of the rolling armor, together with the lower rail, is greater than the friction of rest. Only thus is the armor automatically set in motion, as a result of its own gravitational force, when the shaft is driven in the downward direction. The least friction for the armor is provided when it runs in the raised state vertically into the guides. This type of mounting is called "normal stance". In proportion as the rolling armor runs down, the roll diameter decreases. The armor then runs increasingly more obliquely into the entrances of the guides. When the rolling armor has run down completely, but, as is customary with rolling doors, still hangs with a pull on the shaft, the entire load of the rolling armor in some circumstances hangs only on a single profile of the profiles still located on the shaft. If the vertical cross-section of a rolling door is considered, it will be seen that the pull of the entire dead weight of the armor is not in the door plane, but in the rectilinear connection between the bottom piece and the effective roll radius. The rolling armor will therefore experience deformation in the middle between the guides, in order to come as close as possible to the path of the tensile stress. However, the profile ends are held by the guides and cannot follow the line of tensile stress. Whereas the tensile stress resulting from the dead weight of the rolling armor pulls the armor on the upper part out of the door plane in the direction of the shaft, the guides bend the profile ends towards the door plane again. However, the individual profiles are thereby subjected not only to bending stress, but also to torsional stress. The highest bending and torsional moments occur at the entrance.

In order to reduce the sealing problems involved in the "normal-stance" type of mounting, it was proposed to limit the bending by attaching a pressure shaft. However, this entails a more unsteady and noisier running of the rolling door (see Horst Günter Steuff, "Das Rolltor", ["The Rolling Door"], Düsseldorf, Werner Verlag GmbH, 1987, page 93).

The above-described unfavorable kinematics of the rolling door which has been known (and hitherto scarcely changed) in its basic features for more than one hundred years is to be seen as the main reason for the generation of a large amount of noise during running and, in the final analysis, also for the insufficient high-speed property of the rolling door. The running noises originating essentially from the profile joints occur mainly during the upward travel of the rolling door and then also to an especially pronounced extent in the lower third of the door aperture, in so far as the rolling door has a "normal stance". The noises arise in the vicinity of the lead-in, where the profiles bend, are subjected to high pulls and are rotated in the joints.

Although the hitherto known rolling door, on account of the non-positive and positive connections of its slats, was for a long time considered to be the most cost-effective solution in terms of sealing against wind pressure and safety against unauthorized opening, the poor high-speed properties of the conventional rolling door were recognized at an early stage as being disadvantageous when it was used as an industrial door. The running speeds of a conventional rolling door are approximately 0.25 to 0.35 m/s.

In the industrial sector, high-speed rolling doors having a full-surface door leaf made of flexible material, which can be wound onto a winding shaft or winding drum, have also proved successful as an additional aperture closure. Moreover, rolling doors of this type, whilst offering a suitable choice of flexible material, afford the advantage of optical transparency. Macrolon foils or soft PVC foils, for instance, are in widespread use. However, this advantage over opaque material disappears in time, since the visual transparency is impaired as a result of the penetration of dust and the like during the winding up of the foil, and the associated scratching of the surface.

In view of the limited amount of space available above the lintel region and the large core diameter of the shaft, conventional in foil-type rolling doors, the foils in this type of rolling door have to be as thin as possible, since the overall winding diameter otherwise becomes too large. Furthermore, the provision of thinner foils at the same time allows the door leaf to run at higher speed on account of the easier windability. The small thickness of the foils and accordingly the low dead weight of the door leaf nevertheless lead to a reduced wind-resisting strength. It was proposed, as a remedy for this, to provide additional weight in the form of a closing profile, arranged on the lower edge of the door leaf, or spring-loaded tensioning belts which run over deflecting rollers mounted on the ground.

The greatest disadvantage of the foil-type rolling doors therefore arises from the behavior of the door leaf under wind pressure, which approximates more closely to the behavior of a sail than to the behavior of a plate. Since the door leaf is supported only on the winding shaft, under wind load the door leaf becomes considerably distended and bulged and is consequently also lifted. Rolling doors of this type are therefore to be considered only as an additional closure for a door aperture also in view of deficient safety against unauthorized opening.

Furthermore, so-called sectional doors, e.g. U.S. Pat. No. 3,891,021, which are likewise used for large door apertures, are known. A conventional sectional door consists essentially of an armor having comparatively high sections which can be circulated out of a vertical closed position into an upper horizontal position underneath the ceiling by means of a cable drive.

The comparatively large height of the individual sections which is used in sectional doors results, on account of the reduced number of connecting elements for the sections, such as hinges or the like, and also the reduction in the number of end faces to be sealed off, in a mechanically altogether more compact design having correspondingly good strength against wind forces and safety against unauthorized opening. Furthermore, the large height of the individual sections makes it possible to provide transparent portions in the form of glass or plastic windows.

The compact design of sectional doors makes it possible to provide light-weight doors composed of aluminum sections which are filled, for example, with a plastic material for heat and sound insulation, in order to make it possible to open and close garage doors, even relatively large door widths, solely by manual actuation without an additional electric-motor drive.

As a rule, the individual sections lie on one another in alignment in the closing position, so that the entire end face of a particular section is available for the sealing. The sectional door thus appears almost exactly as a closed door with a continuous outer surface, without intermediate gaps. Further— improved sealing is brought about, for example, by rubber inserts which are compressed, in the closed position, by the sections lying above one another. Alternatively, the sections have a bulge which extends on one end face of the entire door width and which engages into a corresponding depression of an adjacent section during the pivoting of the sections into the same plane as a tongue-and-groove joint, thereby further improving the mechanical strength of the door leaf against wind pressure, even where large door widths are concerned.

On the inside of the door, the sections are connected by means of a plurality of individual hinges which are mounted over the entire width of the door at particular intervals in such a number that sufficiently high strength and support is achieved. The hinges mounted on the lateral edge of the sections are typically designed at the same time as a holder for a roller which can run in a guide rail of U-shape cross-section on the edge region of the sectional door. Since the individual hinges are mounted on the sections in such a way that the sections can be folded away towards the inside, problems arise here in as much as the parts of the hinges mounted on the inside of the door and projecting are visually displeasing and afford danger of injury. A further danger of injury on sectional doors is caused during the angling of the sections, by the open gaps occurring thereby, or during the folding back of the sections and the closing of the gaps.

A further disadvantage of sectional doors having relatively high sections emerges in connection with the arcuate guide part above the lintel region, where the individual sections are articulated from the vertical position into the horizontal position. This movement naturally leads to sudden tilting accelerations and correspondingly, in response to rapid actuation, to considerable force effects on the individual sections. Acceleration and deceleration forces occur as a result of the different radial distances of the guide rollers from the actual location of the mass of the section in the region of the upper curved path, the generally non-uniform force trend resulting from the plane design of the slats of finite height, which are present in the curved path in the manner of a polygon, whereby sectional doors can be operated only at relatively low running speeds, without the risk that a relatively large amount of noise will be generated.

The transmitted transverse forces are also absorbed, by way of the plurality of individual hinges, by the body of the sections and therefore subject these body sections to load. The forces introduced into the edge hinges and correspondingly into the guide rail when the sections are being moved are essentially dependent on the speed of opening and closing of the sectional door. Because the construction is not, in principle, designed for high speeds, limits are placed on the use of sectional doors as industrial doors having a high-speed capability.

In sectional doors, a cable device with hauling cables and carrying cables and cable pulleys arranged on a drive shaft are conventionally provided as a drive system. During the upward travel of the door, the carrying cables are wound onto the cable pulleys, whilst the hauling cables are simultaneously unwound from the cable pulley. During the downward travel of the door, the hauling cables are wound up and thus pull the door down, whilst the carrying cables, without becoming slack, are simultaneously unwound from the cable pulleys. The carrying cables are thereby constantly subjected to tensile stress and cannot run down from the cable pulleys. The drive shaft is driven via an electric motor which, for example, is arranged directly underneath the ceiling.

As is known, to balance the weight of the door leaf, there are torsion springs which are arranged coaxially relative to the continuous drive shaft. In the closed position of the door, the torsion springs are fully tensioned and are correspondingly relaxed during the upward movement of the door leaf. These torsion springs are subject to increased wear and their lifetime is therefore considerably limited. Particularly in the event of a frequent and sudden reversal of direction of the cycle of movement of the sectional door, the torsion springs undergo considerable dynamic stress peaks as a result of the jolting movements. The failure of the torsion spring means that the maintenance and exchange work accompanying this in the sectional doors is time-consuming and laborious.

Because the drive shaft together with the torsion springs is arranged above the arc and the electric motor is arranged in the vicinity of the drive shaft, in conventional sectional doors it is necessary to allow for a considerable space requirement above the lintel which, without special constructive measures, for example, the provision of a double horizontal guide underneath the ceiling or the shifting of the drive shaft together with the torsion springs to the outermost end of the running rails, does not fall below a value of typically 400 mm. Added to this is the space requirement in terms of depth which is excessively high in sectional doors and which corresponds essentially to the clear height of the door aperture. Since, the free space available typically in depth, i.e., the dimension between the rear edge of the lintel and the nearest obstacle in the depth of the room, for example, joist, wall, ventilation pipe, fan or the like, will be meager in many instances the installation of the known sectional door may be impracticable.

BRIEF DESCRIPTION OF THE PRESENT INVENTION

Accordingly, it is an object of the present invention to provide a lifting door which allows high-speed running, eliminating or minimizing the generation of noise during the opening and closing of the door, and which, in the closed state, offers sufficient sealing against wind and weather and security against unauthorized opening and which, furthermore, even with relatively large gate heights, requires only a small space above the lintel.

In a lifting door according to the present invention, the two guide tracks, which are respectively arranged on the two mutually opposite sides of the door aperture, are designed in such a way that, starting from the vertical portion vertically extending approximately over the height of the door aperture, the two guide tracks merge at the entrance of the lifting door into a spiral portion extending spirally inwards. This ensures that, even in the case of a relatively large height of the door aperture, the necessary space requirement for the slatted armor in the open position in the depth of the door is kept as little as possible, without the need for a substantially increased space requirement in terms of the height above the lintel. According to the invention, in the open position of the lifting door, the slatted armor is movable into the spiral portion of the guide tracks, in such a way that the plurality of slats are present in a spiral track and are completely free of contact with one another, so that no frictional or compressive forces occur on the slats and therefore considerable running speeds of the lifting door become possible, without this being accompanied by the generation of an excessive amount of noise. The slats of the slatted armor which cover the width of the door aperture are made anglable relative to one another and are made of rigid material, so that, in the closing position, the lifting door has sufficiently high mechanical stability to withstand even relatively high wind loads and to guarantee security against unauthorized opening.

To adapt to different door heights, according to claim 2 there are extension portions which are simply inserted essentially horizontally into the spiral portion of the guide tracks.

In a further embodiment of the invention, according to claim 3 the guide tracks are provided in the form of a pair of round bars, as a result of which especially the arcuate portions of the guide track can be produced easily.

As an improvement of the drive of the lifting door according to the invention, according to claim 4 there is a weight compensation having a compensating spring and a band which is fastened to the compensating spring and which can be wound up onto a shaft interacting with the drive of the lifting door, this shaft having a predetermined core diameter. The main advantages of this weight compensation are, above all, a lengthened lifetime of the weight compensation, without additional transmission means being necessary to achieve the desired characteristic.

A drive which is advantageous in terms of the possible running speeds of the lifting door according to the invention possesses, according to claim 5, an endless chain which can be driven via an electric motor and which is fastened to the slatted armor at one point. The endless chain is guided so that the pulls exerted when the slatted armor is being moved upwards and pulled down run completely in the plane of the door leaf.

According to claim 6, there is provided as an upper closure of the door aperture a sealing lip which is arranged horizontally approximately over the entire door width and which prevents rainwater, dirt or the like from penetrating into the upper region of the lifting door.

For further details, attention is drawn to and reference is made to the full content of the two parallel German Patent Applications by the same applicant of today's date, entitled "Lifting door with a slatted armor having anglable slats" (Case No. 11EF01412) and "Closure element for an aperture" (Case No. 11EF01432).

BRIEF DESCRIPTION OF THE DRAWING FIGURES

Further details and expedient features of the invention emerge from the following description of an embodiment with reference to the Figures. Of these:

DESCRIPTION OF THE PREFERRED EMBODIMENT

Figure 1:
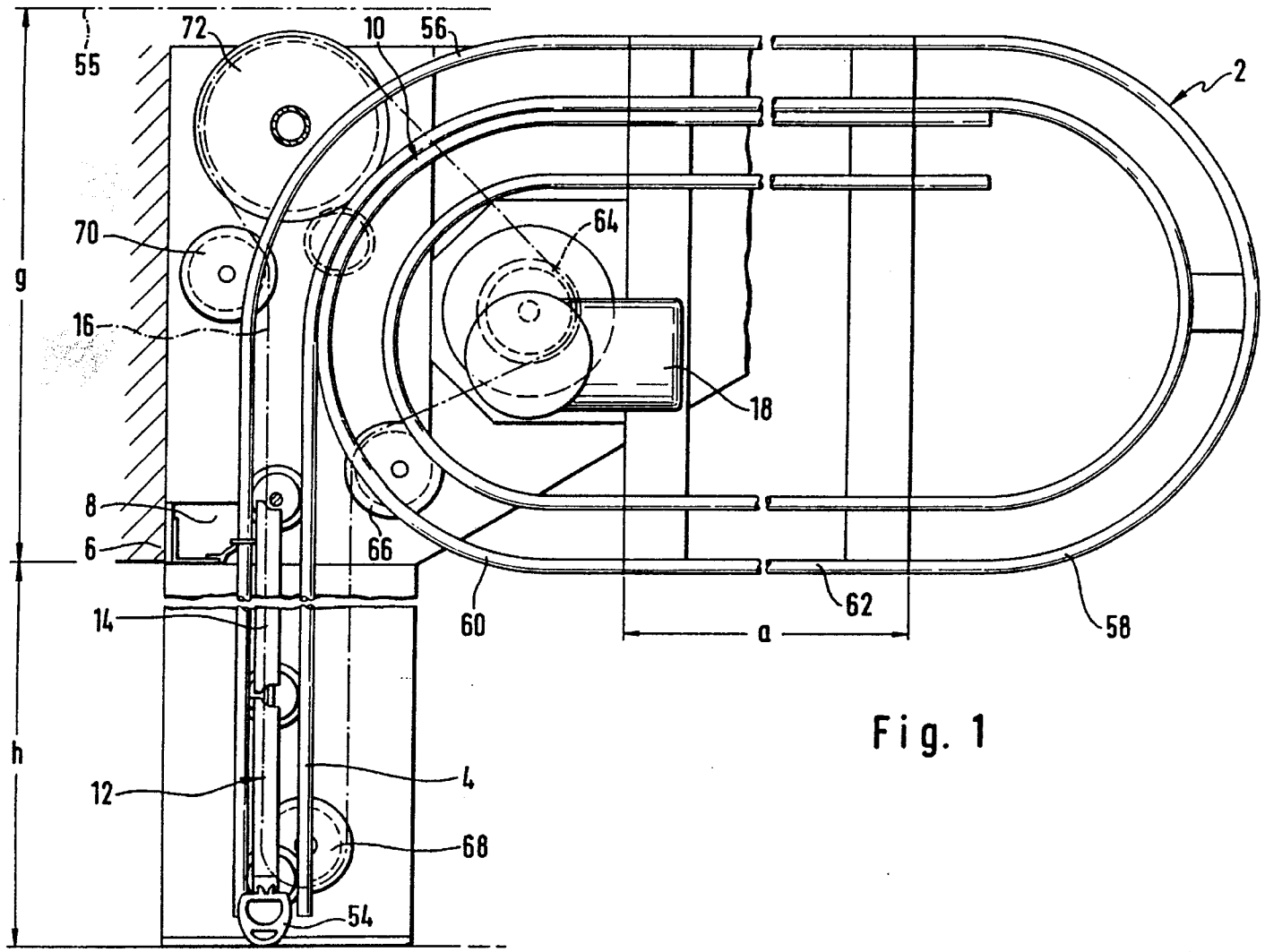
FIG. 1 shows a partial side view of an exemplary embodiment of a lifting door according to the invention.
Figure 4:
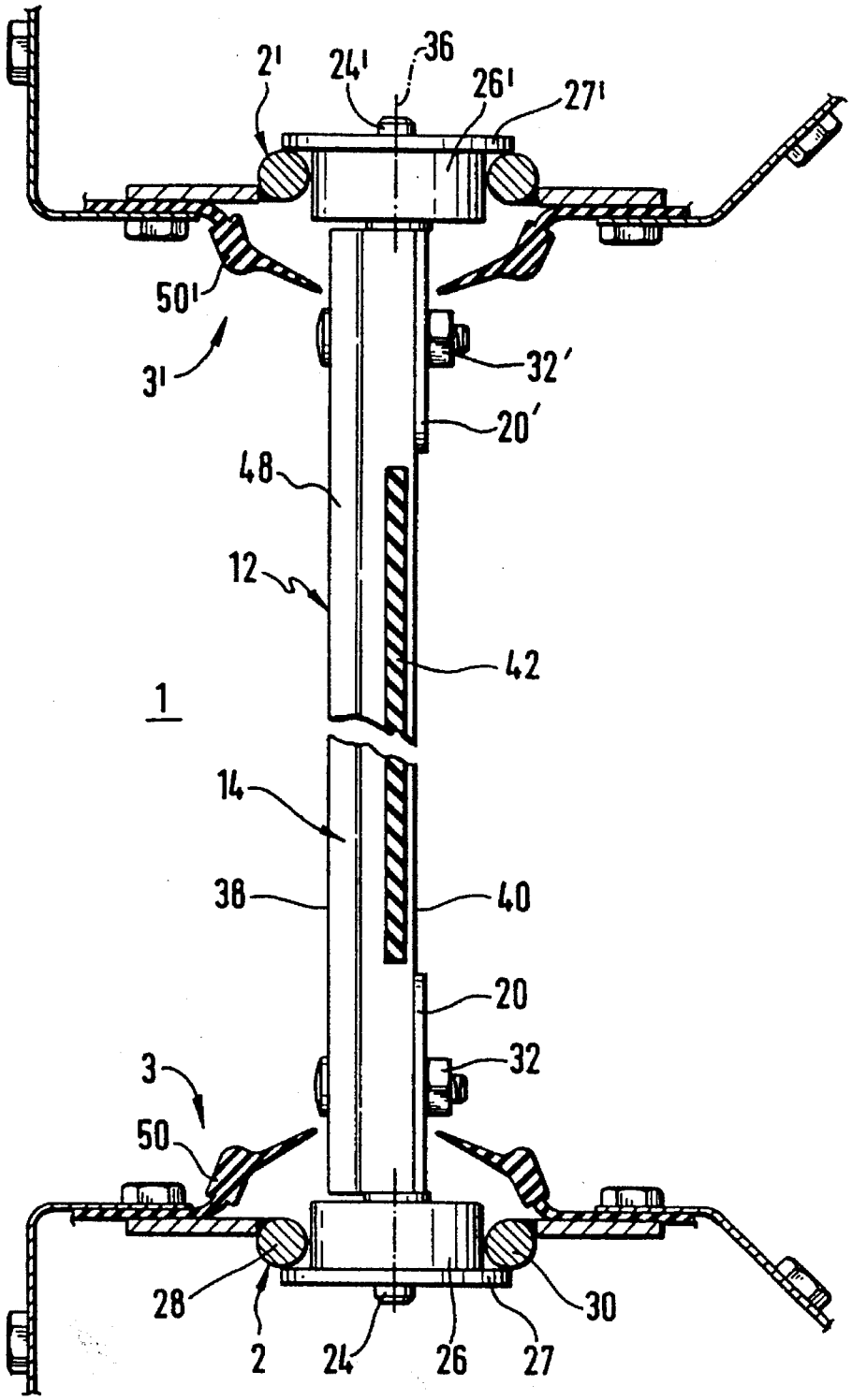
FIG. 4 shows a top view of a slatted armor according to the present invention.

As represented in FIGS. 1 and 4, the illustrated embodiment of a lifting door according to the invention has guide tracks 2 and 2' which are respectively arranged on the two mutually opposite sides 3 and 3' of a door aperture 1. Reference symbols followed by a (') are used to designate the corresponding parts of the lifting door which are arranged on the side 3'. Each guide track 2, 2' has a vertical portion 4 which extends vertically over the height of the door aperture and which extends approximately level with the lintel 6 and opens out at the entrance 8 of the lifting door into an inwardly extending spiral portion 10 in an upper edge region of the door aperture. A slatted armor 12 for closing the door aperture having a door height h is movable upwards into the spiral portion 10 of each guide track, when the door is moved into the open position, in such a way that the slatted armor is arranged spirally, and without slats 14 touching one another touching. An endless chain 16 and an electric motor 18 are provided as a drive for the slatted armor 12.

Figure 2:
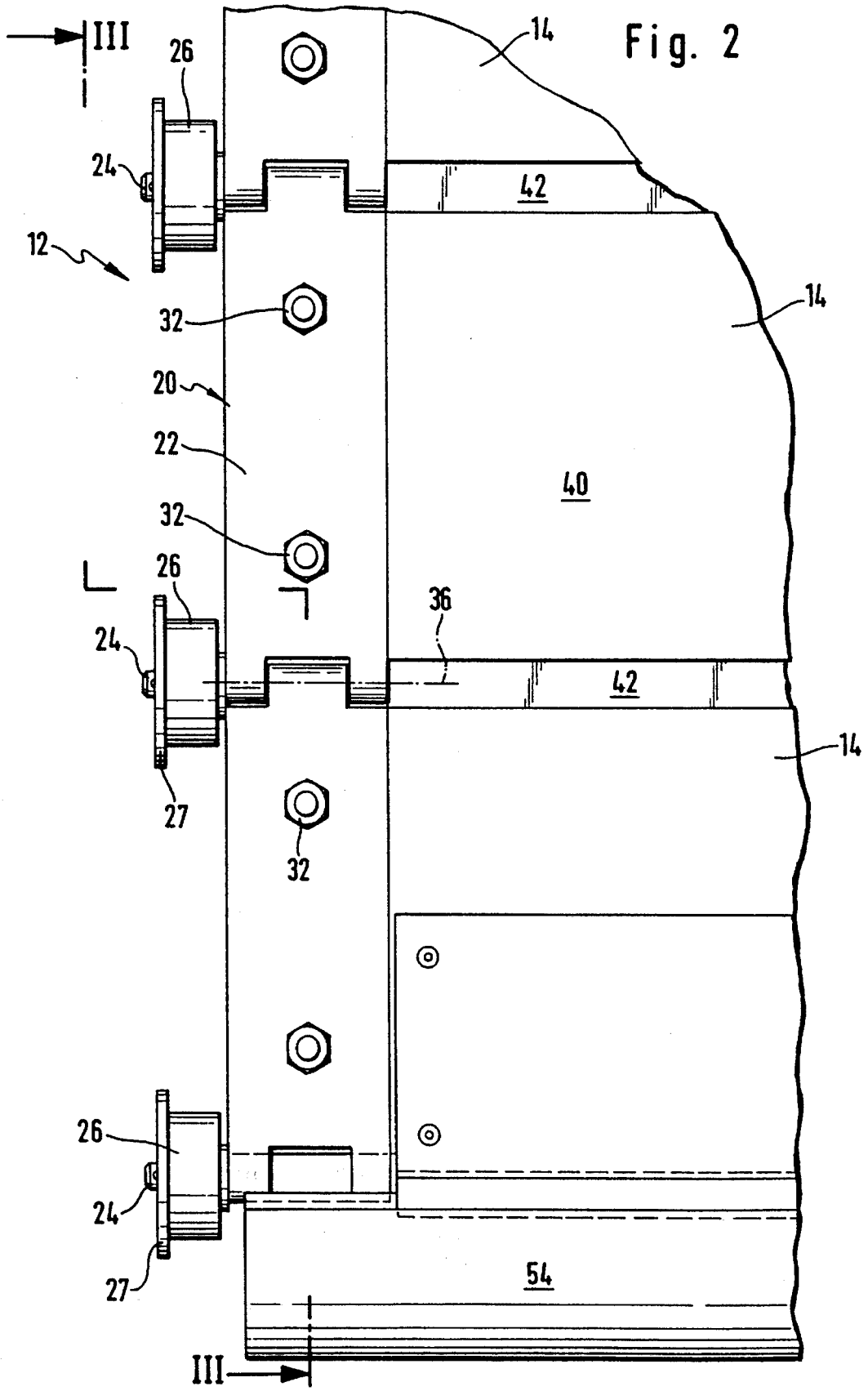
FIG. 2 shows a partial rear view of a slatted armor corresponding to the lifting door according to the invention.
Figure 3:
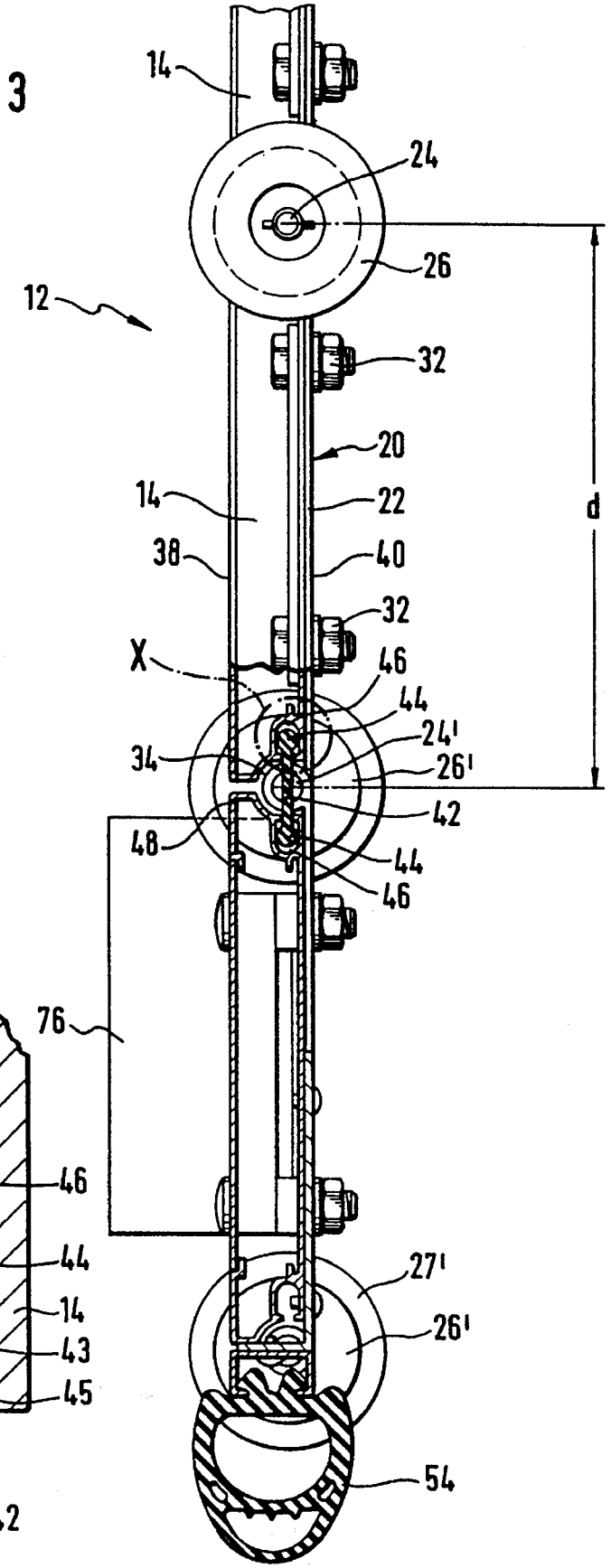
FIG. 3 shows a diagrammatic sectional representation along the line III—III in FIG. 2.

FIGS. 2, 3 and 4 show details of the slatted armor according to the invention. Provided on each of the two edge sides of the slatted armor 12 is a hinge strap 20, 20' which has a length corresponding essentially to the height of the door aperture 1. Hinge strap 20, 20' consists of rigid hinge members 22 which are connected to one another in an articulated manner and which can be angled relative to one another via hinge pins 24, 24'. For this purpose, each hinge member is shaped at its end in a known way to form a rolled-round lug, into which the hinge pin 24 can be inserted. Two respective adjacent hinge members are connected to one another in an articulated manner, in such a way that their lugs are arranged coaxially relative to one another, a common hinge pin 24 being mounted in the coaxial hinge.

Furthermore, in the example shown, rollers 26, 26' are mounted coaxially relative to the hinge pins 24, 24' and serve as rolling guidance for the hinge straps 20 and 20' in the guide tracks 2 and 2'. In the example illustrated, each guide track has a pair of round bars 28 and 30 arranged at a uniform distance from one another which is chosen to match the diameter of the rollers 26. The hinge straps 20, 20' and the round bars 28, 30 are produced, for example, from hard metallic material, whilst the rollers 26 can also be produced from plastic material. To prevent the slatted armor from falling out of the guide track, each roller 26, 26' has a holding collar 27, 27', the outside diameter of which is larger than the clear distance between the round bars 28, 30.

The slats 14 are attached and fastened to the hinge straps 20, 20', for example by means of screw connections 32, 32', in such a way that the resulting distance between the respective adjacent slats 14 forms a space 34, into which are disposed the hinge pins 24, 24' or the lugs surrounding the hinge pins and belonging to the hinge members 22, 22', as is shown best in FIG. 3. According to the invention, this achieves the effect that the geometrical axis of articulation 36 lies within the region which is limited by the two outer main surfaces 38 and 40 of the slatted armor 12. This position of the axis of articulation 36 ensures that the width of the angle opening between the adjacent slats 14 during the angling of the slatted armor is reduced to a minimum, so that the tilting accelerations during entry into the upper bent guide track are correspondingly reduced. The possible running speeds of the lifting door shown are thereby further increased, without this being accompanied by the generation of an excessive amount of noise.

The slats, having a height of, for example, up to 150 mm, are attached completely independently of one another and individually on the hinge straps 20, 20', so that the absence of an entire slat does not affect the mechanical stability and functioning of the lifting door according to the invention. The hinge straps 20 and 20' thus form a supporting structure or skeleton for the slatted armor which absorbs all the forces occurring during the movement of the lifting door. Because of the mechanically continuous cohesion of the hinge straps 20, 20', the pulls or forces which occur are absorbed by the hinge straps 20, 20' and are not transmitted to the slats 14. Because the forces which arise are transmitted and distributed to an articulated, continuous, but tension-resistant strap, a uniform and steady cycle of movement is achieved, even when the lifting door is running at extremely high speed.

Since the individual slats 14 are initially attached at a particular distance from one another on the hinge straps 20, 20', in order thus to make room for the hinge pin, the adjacent slats 14 have no contact with one another even in the closing position of the door, with the result that the rattling noises known in the conventional sectional door when the door is being closed are also eliminated completely in the lifting door according to the invention.

To increase the mechanical stability of the slatted armor and to increase the sealing, but without impairing the properties of the present lifting door as regards low noise generation, there are provided sealing strips 42 in the form of rubber strips which are arranged approximately over the entire door width between the hinge strap 20 and 20' and which connect mutually opposite sides of adjacent slats 14. Each sealing strip 42 is appropriately arranged coaxially relative to the adjacent axis of articulation 36, so that, during the angling of the slatted armor 12 in the upper guide region, the sealing strips 42 are subjected only to bending load. The sealing strips 42 engage with only little lateral play into the slats 14 in a direction perpendicular to the plane of the door leaf, so that the slatted armor 12, when subjected to pressure, is tensioned at a specific point and corresponding restoring forces immediately counteract the pressure load. Each sealing strip 42 has, on opposite sides, beads or thickenings 44 which engage in correspondingly shaped recesses 46 of the slats 14.

Figure 3A:
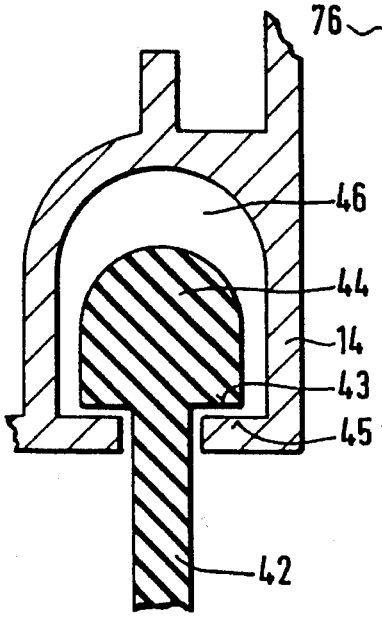
FIG. 3A shows an enlarged representation of the detail X of FIG. 3.

As can best be seen from the enlarged cut-out according to FIG. 3A, each thickening 44 has a supporting face 43 which is arranged opposite a corresponding holding face 45 of the slat 14. The distance between a supporting face 43 and the respective associated holding face 45 of the slat 14 is selected as small as possible—allowing for jam-free and fault-free mounting by insertion of the sealing strip 42 with the thickening 44 into the recess 46 from the side. Thus, in the closing position of the slatted armor, pressure loads possibly occurring on the slatted armor result in the sealing strip 42 being tilted to the side and, after the supporting face 43 begins to come into contact with the holding face 45, the sealing strip 42 is subjected to tension relative to the two adjacent slats. In the event of even smaller deflections of the slat out of the plane of the door leaf, as long as the supporting face 43 does not touch the opposite holding face 45, the sealing strip 42 is subjected only to bending stress relative to the two adjacent slats, thus leading to corresponding restoring forces. Since the distance between the supporting face 43 and the associated holding face 45 is chosen to be a minimum, even when there are only small deflections, to ensure that the sealing strip is subjected to tension, the pressure loads occurring on the slatted armor are thus also transmitted and distributed from the initially directly affected sealing strip 42 to the adjacent sealing strips. Thus, in the event of a pressure load, the slatted armor according to the invention behaves largely in the same way as a homogeneous plane plate, with a corresponding force distribution in the plate plane, but with a slight deflection under low pressure forces. The sealing strips 42 therefore bring about an appreciable increase in the mechanical stability of the slatted armor, so that, in the closing position, the lifting door can withstand even high wind loads or other pressure loads easily.

Of course, the lifting door according to the invention also affords sufficient safety against unauthorized opening, so that the lifting door according to the invention comprises a permanent closure for the door aperture.

To prevent the slatted armor 12 from being pulled out, e.g., under high pressure forces, there are arranged on the two mutually opposite sides of the slatted armor holding collars 27, 27' which, in the exemplary embodiment illustrated, are designed as an outer disk having a diameter larger than the diameter of the rollers 26, 26'. The holding collars 27, 27' are slightly spaced from adjacent supporting faces of the guide bars 28, 30, so that they bear against the outside of the guide bars 28, 30 for support only when the slats 14 bend very sharply under load, with the result that the slatted armor remains easily movable under relatively low pressure loads. Even under a load at particular points, the above-described force distribution via the sealing strip 42 in the plane of the door leaf prevents the holding collars 27, 27' of a loaded slat 14 from providing support prematurely as a result of the pronounced bending out of the latter and from thereby impeding the movement of the slatted armor.

In the exemplary embodiment shown in FIG. 3, each slat 14 has a sealing nose 48 which projects on the outside 38 in the plane of the door and by means of which the distance from an adjacent slat is reduced. Because of the sealing nose 48, the sealing strip 42 cannot be seen from outside in the closed position. The sealing strip 42 is then visible only from the inside (see the rear view according to FIG. 2). At the same time, the design of the sealing nose 48, as shown in FIG. 3, results in a more pleasing appearance of the slatted armor 12 in the form of a more uniform smooth surface.

As protection for an individual's fingers and to prevent injuries caused by unintentionally touching movable parts, according to FIG. 4 there are provided respectively on the inside and outside of the door aperture sealing lips 50, 50' which, in the closed position, project as far as the position of the sealing strips 42 in the plane of the door leaf. The sealing lips located on the outside of the door aperture 1 form at the same time a seal against driving rain, dust or the like. These sealing lips can, for example, be produced from rubber.

Figure 5:
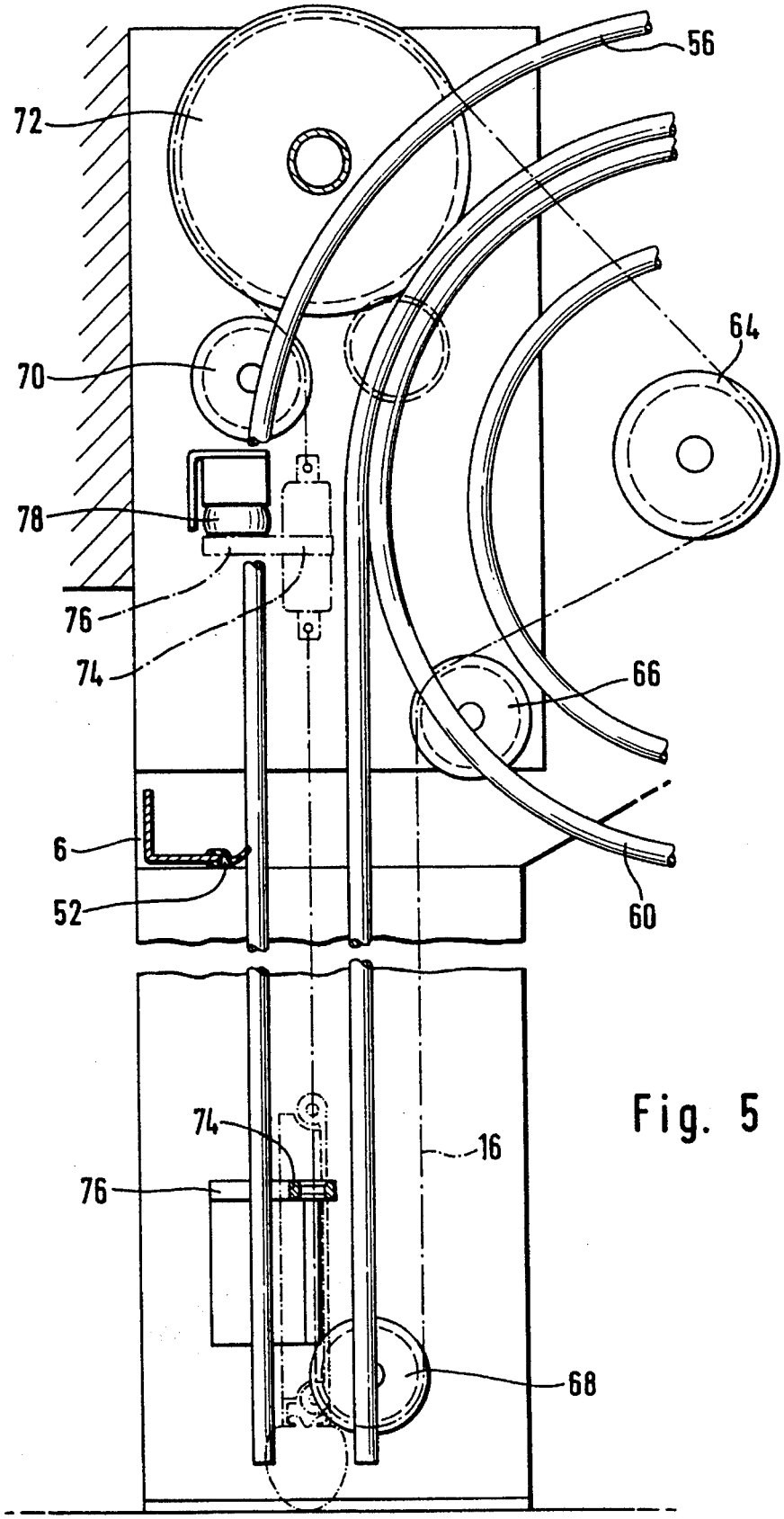
FIG. 5 shows a sectional side view of an exemplary embodiment of the lifting door according to the invention.

A sealing lip 52 formed with a similar cross-sectional shape is arranged in the region of the lintel 6 (FIG. 5) and extends horizontally essentially over the entire width of the door aperture. The sealing lip 52 prevents rainwater or dirt from penetrating into the upper region of the lifting door.

To seal off the lifting door relative to the ground, according to FIG. 3 a closure 54, for example made of rubber, is provided and is fastened to the lowest slat.

As already explained with reference to FIG. 1, the lifting door according to the invention has the two guide tracks 2 and 2', in the upper region of the door and underneath the ceiling indicated by the reference symbol 55 formed, as a spiral portion 10 extending spirally inwards. In the open position of the lifting door, the slatted armor 12 is movable into the spiral portion in such a way that the plurality of slats are present in a spiral track and free of contact with one another. In contrast to known rolling doors, in which the rolling armor is wound up on a winding shaft, according to the invention the slatted armor is always guided in such a way that the slats never touch one another. As a result, the pressure forces occurring in the rolling door on the slats are avoided completely, so that a correspondingly steady running allowing high speeds becomes possible. In contrast to the conventional sectional door, the upper guide track is not guided as a straight stretch directly underneath the ceiling, which used to lead, particularly where larger door heights were concerned, 30 to a considerable space requirement in terms of the depths of the door. In contrast to this, according to the exemplary embodiment shown in FIG. 1 the spiral portion 10 has the three arcuate portions 56, 58 and 60. As illustrated, part of the arcuate portion 60 bears directly against the arcuate portion 56, so that the inner radius of the arc 56 corresponds approximately to the outer radius of the arc 60. The outer radius of the arc 58 corresponds to the outer radius of the arc 56.

According to FIG. 1, the smallest possible occurring radius of curvature of the guide track 2 is equal to the radius of the innermost arc portion 60. This radius is selected so that a proper entry of the slatted armor 12 into the spiral portion 10 is possible in dependence essentially on the distance d between the adjacent hinge pins (see FIG. 3), without, for example, the fear of self-locking of the angled slats in the narrowest arc portion. A self-locking of this kind would occur at the latest when, during the entry of the slatted armor 12, the force fraction, directed parallel to the guide track, for overcoming the rolling friction at any point on the guide track becomes smaller than the rolling-friction component which acts correspondingly at this point and which is itself proportional to the normal force present at this point. In practice, however, the smallest possible arc radius is already limited by the fact that, during the angling of the slats, the sealing strips are bent, thereby generating restoring forces which have to be overcome by the drive of the lifting door and which are the greater, the narrower the selected guide arc.

The spiral arrangement of the guide track 2 utilizes the height g available above the lintel region to the best possible effect. The arcuate portions 56, 58, 60 can be standardized for all door heights occurring in practice, so that, irrespective of the particular door height, the lifting door according to the invention affords the advantage of a standard dimension for the height above the lintel. The adaptation of the total length of the guide track to the individual door height of a particular user is guaranteed by separately insertable horizontal extension portions 62 of length a. In the instance shown, the length of the complete guide track 2 is increased by the insertion of the extension portions 62 by 3×a in total. Since these portions constitute essentially the only parts of the lifting door which have to be manufactured or made available individually according to the door height, the lifting door according to the invention can be produced cheaply in large quantities and therefore also gain acceptance in more commonplace uses outside the industrial sector.

Actual numerical values are indicated below for further illustration. At the current clear door heights of h=3 m, 4.5 m and 6 m, the values of the extension portions 62 correspond respectively to a=0 m, 0.5 m and 1 m. Thus, with a fixed value of the constructional height above the lintel of g=0.5 m, for an increase in the clear door height from 3 m to 6 m the space requirement in terms of depth increases only by 1 m. The diameter of the rollers 26 and therefore the clear distance between the guide tracks amounts to approximately 4 cm. In this arrangement, it is possible, for example, to open the door of height 8=3 m completely in not less than 2 s.

According to FIG. 1, the electric motor 18, which is connected to a driving roller 64, is arranged in the free space remaining inside the spiral portion 10. The dot-and-dash line in FIG. 1 indicates diagrammatically the endless chain 16 which is driven by means of the driving roller 64 and the motor 18 and which chain is guided over deflecting rollers 66, 68, 70 (FIG. 5) and 72. Provided on the opposite side 3' of the door are deflecting rollers (not shown) which correspond to the deflecting rollers 68, 70, 72 and of which one deflecting roller is connected, for example via a coupling and a torsion shaft, rigidly in terms of rotation to the deflecting roller 72 and therefore serves as a gearwheel and drives a further endless chain (not shown). A further advantage of the lifting door according to the invention is that the torsion shaft constitutes the only constructional element which has to be made to order with an appropriate length in dependence on the desired door width.

In the region of a lower slat, the endless chain 16 is fastened to the slatted armor via a shackle 74. According to FIG. 5, the connection of the chain to the slatted armor is most expediently provided in such a way that the pull exerted during the upward movement of the slatted armor from the closed position to the open position runs completely within the plane of the door leaf, thus avoiding horizontally running force components which would lead to a tilting moment of the slatted armor, with the result that forces seeking to press the guides apart from one another would act on the guide tracks, whilst the rollers would be subjected to increased wear on account of the massive load.

Furthermore, the shackle 74 has, for example, a projecting rigid end 76 which, in the open position of the door, butts against a rubber buffer 78, attached above the lintel, without any substantial noise being generated.

Figure 6:
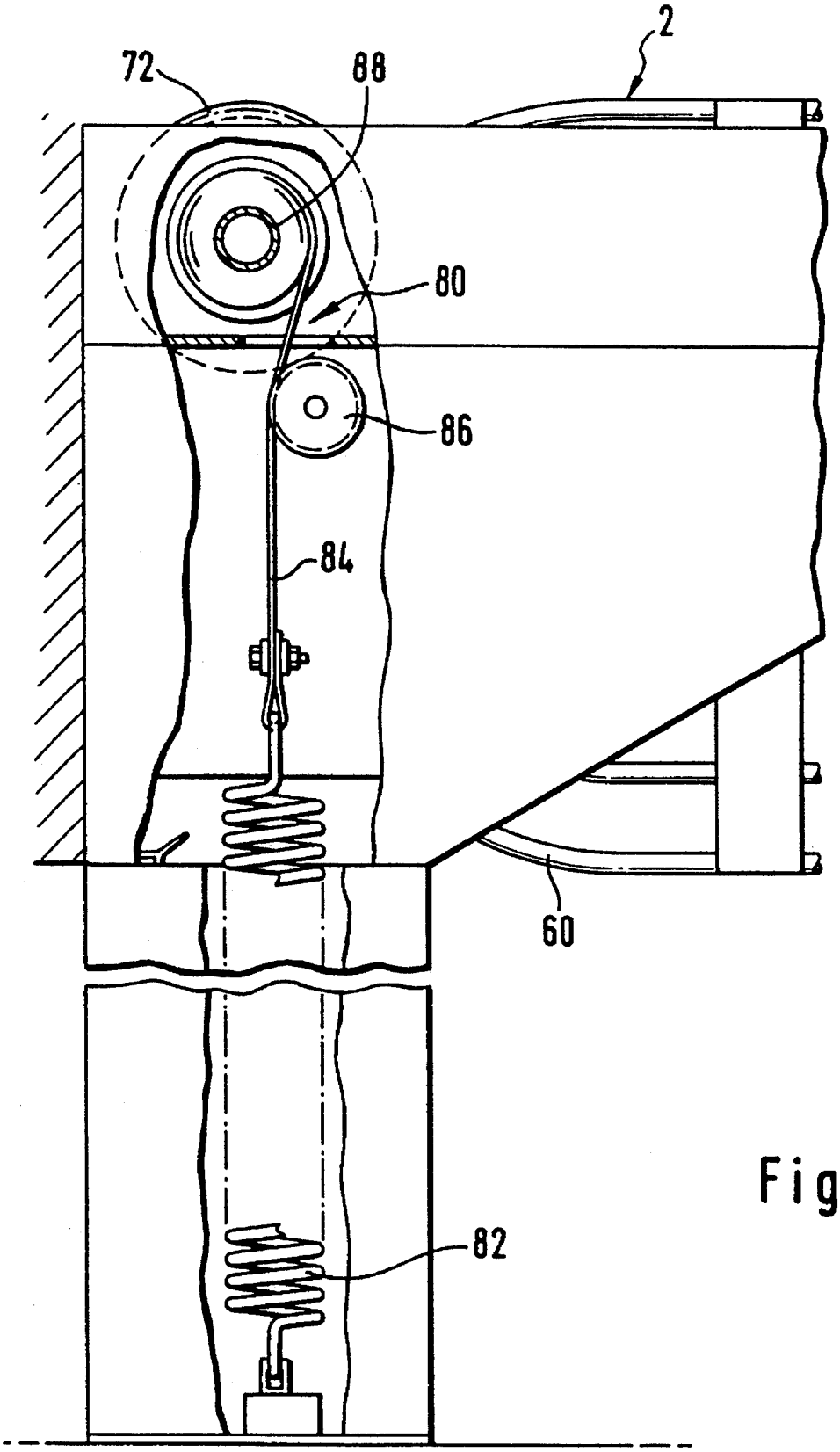
FIG. 6 shows a diagrammatic side view to illustrate the weight compensation of an exemplary embodiment of the lifting door according to the invention.

According to FIG. 6, to adapt the pull acting on the drive of the lifting door to the particular weight of the free length of the slatted armor, a weight compensation 80 is provided and which has a compensating helical spring 82 and a band 84 fastened to spring 82 and consisting of a largely inelastic and tension-resistant material. The lower end of the compensating spring 82 is connected firmly to the ground. The band 84 is wound up via a deflecting roller 86 by means of a shaft 88 which interacts with the drive of the lifting door, for example via the deflecting roller 72 shown in FIGS. 1 and 5, specifically in such a way that, during the upward movement of the slatted armor, the band 84 is unwound from the shaft 88 and the spring 82 correspondingly relaxed. During the lowering of the slatted armor, the band 84 is wound onto the shaft 88, with a pull exerted correspondingly on the compensating spring 82, so that the latter is tensioned.

Figure 7:
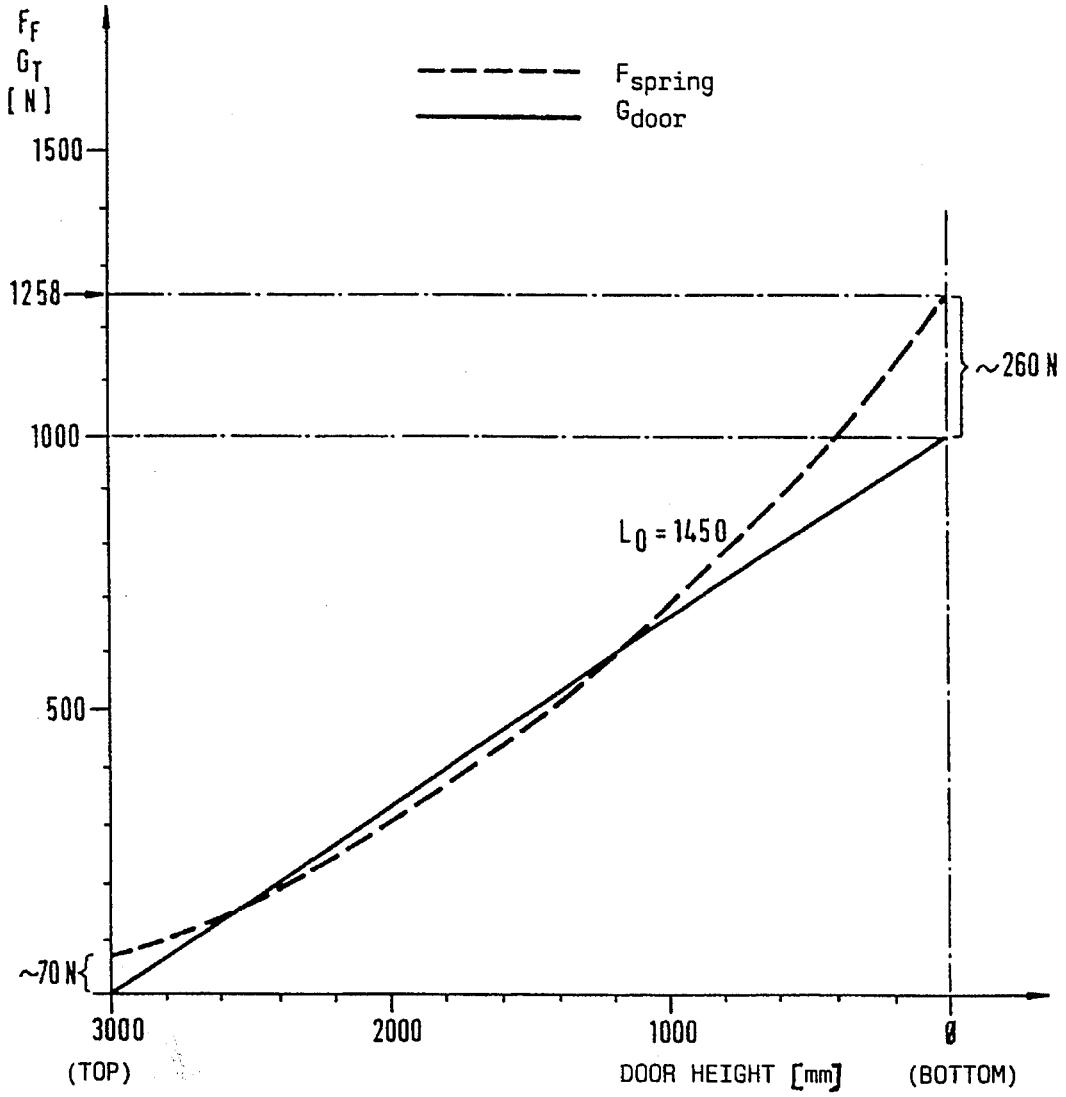
FIG. 7 shows the characteristic of the weight compensation according to the invention shown in FIG. 6.

The shaft 88 has a predetermined core diameter, the value of which is selected so that, in dependence on the thickness of the band 84, the length $L_o$ of the compensating spring 82 at rest, the spring strength of the compensating spring 82 and the total weight of the slatted armor, the desired characteristic of the weight compensation 80, as shown in FIG. 7, according to the door height is obtained.

In FIG. 7, for an illustrative clear door height of 3 m, the respective clear height of the remaining door aperture is plotted in millimeters on the right, the value "0 mm" representing the completely closed door and the value "3000 mm" representing the completely opened door, and at the top the total weight $G_T$, acting on the drive, of the free slatted armor is plotted as a continuous line and the spring force $F_F$ likewise acting on the drive is plotted as a broken line. As can be seen from FIG. 7, the weight compensation 80 is set so that, with the door closed, the compensating spring is expanded until an excess spring force of approximately 260 N over and above the weight of the slatted armor is provided. This ensures that, when the closed door is being actuated, the slatted armor also moves upwards without an additional drive, approximately to the height at which the weight of the free slatted armor is in equilibrium with the corresponding spring force. In FIG. 7, this is represented by the point where the two lines intersect, that is to say at a height of approximately 1 m. During the further upward movement of the door, the respective weight is approximately in equilibrium with the acting spring force, so that the drive need take effect essentially only counter to the existing frictional forces. Further details can easily be taken directly from FIG. 7, without the need for further explanation.

For reasons of space, in the lifting door according to the invention, a weight compensation having at least one compensating spring is provided on each of the two sides of the door.

The weight compensation shown here has decisive advantages over the known solutions. In comparison with the torsion springs used in conventional sectional doors, the lifetime is markedly increased due to the use of a compensating spring in the form of a helical spring. The lifetime of a helical spring is approximately double the lifetime of a torsion spring. This reduces the problem of the complicated exchange of the power unit in the sectional door. Moreover, the lateral compensating springs 82 do not require any space above the lintel.

A further advantage of the weight compensation according to the invention emerges from the use of the band 84 which has a thickness of 2 mm in the instance shown. In comparison with this, if a wire cable were used, a further transmission, for example in the form of a loose roller would be necessary in particular, since it would be possible to wind up a cable only in turns lying next to one another on a pulley, specifically with a correspondingly larger core diameter. By contrast, according to the invention, the band can be wound up on a shaft stub of relatively small core diameter, so that additional transmission means is not required. Moreover, the band is wound up with turns lying above one another, so that the winding radius quickly becomes larger, as desired, starting with the open position of the door, but, with the roll wound up approximately completely in the closed position of the door, changes only a little.

As can easily be seen, the main advantages which can be achieved with the special type of weight compensation described have particular importance in combination with the further features of the present invention, but they also plainly have independent importance, since these advantages can otherwise be used independently of details of the design of the door.

I claim:

1. A lifting door for a door aperture comprising:

a door body for opening and closing the door aperture and including a plurality of substantially rigid slats pivotally coupled to one another and carrying guides at opposite sides thereof;

guide tracks extending substantially vertically along opposite sides of the door aperture for substantially the full height of the door aperture and curved above the door aperture into an inwardly directed, generally spiral configuration, said guides lying in engagement with said guide tracks such that, when the door body is moved to an open position, the guides follow the curvature of said guide tracks to locate the slats between the spirally configured guide tracks and without contact with one another;

each said guide track comprising a pair of guide bars and said guides comprising rollers engaging said bars.

2. A lifting door according to claim 1 wherein said curved guide tracks include at least first and second portions each curved at least 90°.

3. A lifting door according to claim 2 wherein said guide track includes a substantially linearly extending portion between said first and second portions, whereby said first portion transitions between a vertical orientation to a horizontal orientation, said linear portion extends generally horizontally and said second portion transitions between a horizontal orientation to at least a vertical orientation.

4. A lifting door according to claim 2 wherein said second portion of said curved guide track extends 180° and a third portion of said curved guide track extends from said second portion in excess of 90° such that said third portion has in part an outer radius corresponding to an inner radius of said first portion.

5. A lifting door according to claim 4 wherein said guide track includes a substantially linearly extending portion between said first and second portions, whereby said first portion transitions between a vertical orientation to a horizontal orientation and said linear portion extends generally horizontally, said second curved portion extending about 180°, said guide track including a second substantially linearly extending portion between said second curved portion and said third curved portion whereby said second linear portion extends substantially horizontally substantially parallel to the first mentioned linear extending portion.

6. A lifting door according to claim 1 including a drive for lifting the door body, an endless element connected to the door body and said drive for lifting the door body.

7. A lifting door according to claim 1 including a sealing lip disposed within the door aperture and extending substantially horizontally along an upper edge thereof and approximately the entire door width, said sealing lip projecting perpendicular to the plane of the door into the region of the guide tracks.

8. A lifting door according to claim 1, wherein said guide bars have circular cross-sections.

9. A lifting door for a door aperture comprising:

a door body for opening and closing the door aperture and including a plurality of substantially rigid slats pivotally coupled to one another and carrying guides at opposite sides thereof;

guide tracks extending substantially vertically along opposite sides of the door aperture for substantially the full height of the door aperture and curved above the door aperture into an inwardly directed, generally spiral configuration, said guides lying in engagement with said guide tracks such that, when the door body is moved to an open position, the guides follow the curvature of said guide tracks to locate the slats between the spirally configured guide tracks and without contact with one another; and a drive for lifting the door body and including a driven shaft coupled to said drive and a weight compensation system for adapting the lift of the door body by said drive substantially to the weight of the door body;

said system including a compensating spring and a band connecting to said compensating spring and said driven shaft for winding thereabout.

* * * * *

UNITED STATES PATENT AND TRADEMARK OFFICE

CERTIFICATE OF CORRECTION

PATENT NO. : 5,484,007
DATED : January 16, 1996
INVENTOR(S) : Gabrijel Rejc

It is certified that error appears in the above-identified patent and that said letters patent is hereby corrected as shown below:

Column 7, line 9, change "3" to --8--; line 13, change "4" to --9--; line 24, change "5" to --6--; line 30, change "6" to --7--.

Column 12, line 2, change "8=3 m" to --h=3 m--.

Signed and Sealed this

Twentieth Day of August, 1996

*Attest:*

*Attesting Officer*

BRUCE LEHMAN

*Commissioner of Patents and Trademarks*